United States Patent [19]

Paulin et al.

[11] 4,404,761

[45] Sep. 20, 1983

[54] DIGGING TOOTH MOUNTING BRACKET

[75] Inventors: Stephen V. Paulin; Randy H. Hillard, both of Wichita; Stephen A. Youngers, Clearwater, all of Kans.

[73] Assignee: J. I. Case Company, Racine, Wis.

[21] Appl. No.: 280,747

[22] Filed: Jul. 6, 1981

[51] Int. Cl.[3] ..... E02F 3/14

[52] U.S. Cl. ..... 37/191 A; 37/83; 299/82; 299/91

[58] Field of Search ..... 37/83, 191 A, 191 R, 37/141 R, 141 T, 142 R, 142 A; 299/82, 83, 84, 91; 172/100, 753; 403/408, 388, 379, 187, 189, 247

[56] References Cited

U.S. PATENT DOCUMENTS 3,913,979 10/1975 Strauss et al. ..... 37/191 A X

*Primary Examiner*—Edgar S. Burr
*Assistant Examiner*—Moshe I. Cohen
*Attorney, Agent, or Firm*—Cullen, Sloman, Cantor, Grauer, Scott & Rutherford

[57] ABSTRACT

A digging chain is provided with a plurality of trencher or digging teeth mounting brackets at spaced intervals around its periphery. Each mounting bracket is secured to the digging chain by spaced apart adaptor links and pin connections. The mounting bracket includes a base having opposed end surfaces, opposed side surfaces, and a top surface for mounting a trencher or digging tooth cutter bit. A one-piece mounting member is attached to the underside of the base for permitting the base to be securely attached to the upper ends of the adaptor links. The mounting member is generally in the shape of a "W" in longitudinal cross-section and includes opposed leg portions that are secured to the end surfaces of the base. The upper terminal end of the mounting member's mid-portion is secured to the underside of the base, and the lower end of the mounting member forms a pair of mounting slots or grooves that fit between the opposed, spaced apart adaptor links for attachment thereto. The mounting bracket substantially reduces the number of mounting parts required and is inexpensive to manufacture.

1 Claim, 2 Drawing Figures

DIGGING TOOTH MOUNTING BRACKET

BACKGROUND OF THE INVENTION

The present invention relates to an improved support assembly for trencher or digging teeth and, more particularly, to a detachable trencher tooth mounting bracket which is simple and inexpensive to manufacture, convenient and quick to assemble, and dependable in operation.

It is conventional to provide a trenching machine including a boom which serves as a guide for a continuous digging chain that carries trenching teeth at spaced intervals. In accordance with known constructions, the digging teeth may be replaceable and retained in holders which are connected to the digging chain.

A problem with known attachment mechanisms for trencher or digging teeth is that several pieces of mounting hardware are required to attach each tooth which results in the attachment mechanism being expensive and the installation and removal procedure for the teeth being time-consuming. Another disadvantage of prior constructions is that some of the attachment mechanisms use a heavy bracket that is spaced above the upper edges of the digging chain links thereby resulting in a relatively high profile and greater loads at the attaching points during digging.

Accordingly, it is an object of the present invention to provide a support assembly for trencher or digging teeth which substantially reduces the number of mounting parts equipped and is inexpensive to manufacture. It is another object of the present invention to provide a detachable trenching tooth mounting assembly which is simple in construction, convenient and quick to assemble, and dependable in operation. A further object of the present invention is to provide a mounting assembly which utilizes a low profile relative to the digging chain links thereby resulting in less load at the attaching points.

SUMMARY OF THE INVENTION

In accordance with the present invention, a digging chain is provided that carries a plurality of trencher or digging teeth mounting brackets at spaced intervals around its periphery. Each mounting bracket is secured to the digging chain by spaced apart adaptor links and pin connections. The mounting bracket for trencher or digging teeth of the present invention substantially reduces the number of mounting parts required and is inexpensive to manufacture.

The mounting bracket includes a base having opposed end surfaces, opposed side surfaces, and a top surface for mounting a trencher or digging tooth cutter bit. A one-piece mounting member is attached to the underside of the base for permitting the base to be securely attached to the upper ends of the adaptor links with the opposed side surfaces of the base overlapping the ends of the adaptor links.

The mounting member is generally in the shape of a "W" in longitudinal cross-section, and includes opposed leg portions that are welded or otherwise secured to the opposed end surfaces of the base. The upper terminal end of the mounting member's mid-portion may be welded or otherwise secured to the underside of the base.

The lower end of the unique mounting member forms a pair of mounting slots or grooves that fit between the opposed, spaced apart adaptor links for attachment thereto. Fasteners are inserted through aligned openings in the adaptor links for engagement with the bottoms of the slots or grooves, thereby snugly securing the mounting bracket base to the upper ends of the adaptor links and preventing any relative movement between the mounting bracket and adaptor links.

Thus, the trencher or digging tooth mounting bracket of the present invention substantially reduces the number of mounting parts required and is inexpensive to manufacture. It is simple in construction, convenient and quick to assemble, and dependable in operation. Further, the mounting bracket provides a low profile for the digging tooth cutter bit relative to the digging chain links thereby resulting in less loads at the attaching points.

Other advantages and meritorious features of the trencher or digging tooth mounting bracket of the present invention will be more fully understood from the following description of the invention, the appended claims, and the drawings, a brief description of which follows.

DETAILED DESCRIPTION OF THE INVENTION

Figure 1:
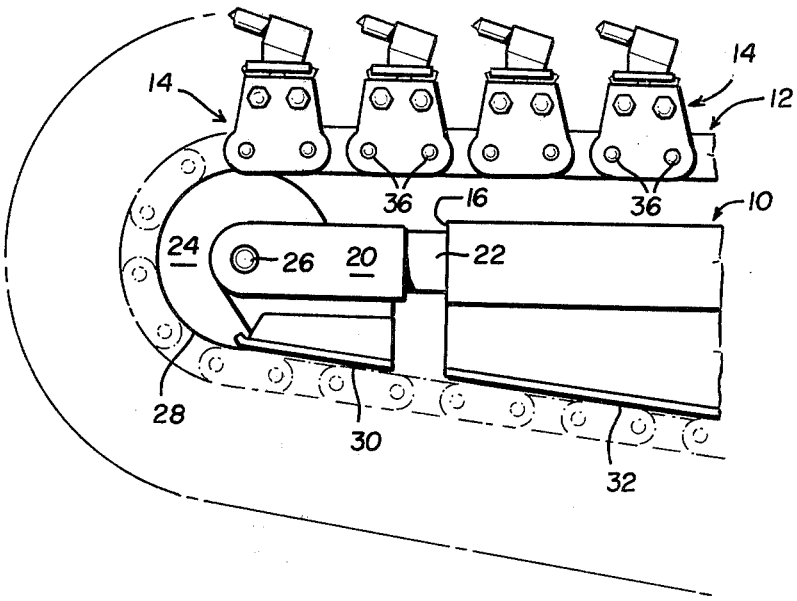
FIG. 1 is a partially fragmented side view showing the outer end of a boom and digging chain carrying a plurality of trencher or digging teeth mounting brackets made in accordance with the present invention.
Figure 2:
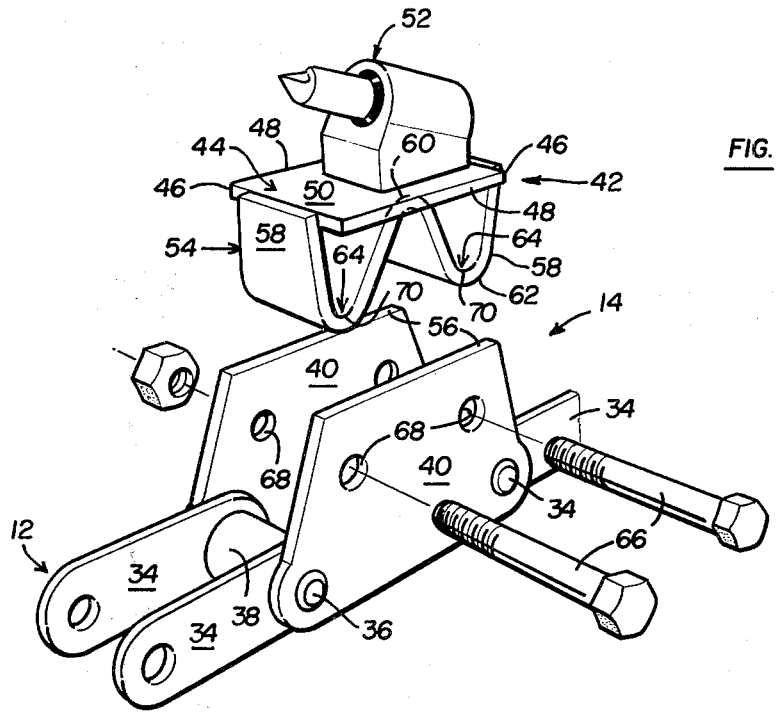
FIG. 2 is an assembly perspective view of the trencher or digging tooth mounting bracket.

A preferred embodiment of the trencher or digging tooth mounting bracket made in accordance with the teachings of the present invention is illustrated in FIGS. 1–2.

FIG. 1 of the drawings shows the outer portion of a boom 10 carrying a chain 12 which is equipped with trencher or digging tooth assemblies 14. The boom is provided on its outer end 16 with extendable boom end means. The extendable boom end means comprises an inner portion 20 which is resiliently and extendably supported on extendable boom end mount 22 that is telescoped into an opening in outer end 16 of boom 10. Suitable adjusting means (not shown) may be provided between boom end means and boom 10 Shock absorbing means in the form of a compression spring may be interposed between boom 10 and boom end means to allow boom end means to move in and out with respect to boom 10 to absorb shock applied thereto by chain 12.

The extendable boom end means includes an idler pulley 24 having circumferential surface 28 supported by roller pin 26 which allows the idler pulley to rotate freely. Chain 12 is carried on boom 10 in sliding engagement with surfaces 30 and 32 and in rotating engagement with circumferential surface 28 of idler pulley 24. Chain 12 may be driven by conventional means, such as by a sprocket at or near the inner end of the boom (not shown).

Referring to FIG. 2, chain 12 includes links 34 which are connected by pins 36 that support rollers 38. Chain 12 also has a plurality of trencher or digging tooth assemblies 14. Each assembly 14 is secured to the chain by adaptor links 40 which are secured to the chain by pins 36 that connect the links and rollers of the chain. Adaptor links 40 are secured to a trencher or digging tooth mounting bracket 42 made in accordance with the present invention.

The mounting bracket 42 includes a base 44 having opposed end surfaces 46, opposed side surfaces 48, and a top surface 50 for mounting a trencher or digging tooth cutter bit 52. A one-piece mounting member 54 is attached to the underside of base 50 for permitting the base to be securely attached to the upper ends 56 of adaptor links 40 with the opposed side surfaces 48 of the base overlapping the ends 56 of the adaptor links.

Mounting member 54 is generally in the shape of a "W" in longitudinal cross-section, and includes opposed leg portions 58 that are welded or otherwise secured to the opposed end surfaces 46 of base 44. The upper terminal end of the mounting member's mid-portion 60 may be welded or otherwise secured to the underside of base 44.

The lower end 62 of the unique mounting member 54 forms a pair of mounting slots or grooves 64 that fit between the opposed, spaced apart adaptor links 40 for attachment thereto. Fasteners 66 are inserted through aligned openings 68 in the adaptor links 40 for engagement with the bottom 70 of the slots or grooves 64 thereby snugly securing the mounting bracket base 44 to the upper ends 56 of the adaptor links 40 and preventing any relative movement between the mounting bracket and adaptor links.

Thus, the trencher or digging tooth mounting bracket 42 of the present invention substantially reduces the number of mounting parts required and is inexpensive to manufacture. It is simple in construction, convenient and quick to asemble, and dependable in operation. Further, the mounting bracket 42 provides a low profile for the digging tooth cutter bit 52 relative to the digging chain links 40 thereby resulting in less loads at the attaching points.

It will be apparent to those skilled in the art that the foregoing disclosure is exemplary in nature rather than limiting, the invention being limited only by the appended claims.

We claim:

1. A support assembly for digging teeth comprising:

a digging tooth mounting bracket which is secured to opposed, spaced apart adaptor links, said adaptor links having upper ends and aligned mounting openings therethrough for attaching said mounting bracket, said mounting bracket including a base having opposed vertical end surfaces, opposed vertical side surfaces, and a top surface for mounting a digging tooth cutter bit;

a one-piece continuous plate-like mounting member attached to said base, said mounting member being generally in the shape of a "W" in longitudinal cross-section and including opposed divergent leg portions that are secured against the opposed end surfaces of said base, each divergent leg portion being of a width less than the length of the end surface to which it is secured, said mounting member having a mid-portion with an upper radiused terminal end that engages the underside of said base, said divergent leg portions joined to said mid-portion through radiused bottom portions for forming a plurality of transversely disposed large, open area mounting slots or grooves that fit between said opposed, spaced apart adaptor links for attachment thereto, said large, open area mounting slots or grooves being formed between said divergent leg portions and said mid-portion; and fastening means extendable through the mounting openings in one of said adaptor links into the large, open area mounting slots or grooves between said divergent leg portions and said mid-portion, said fastening means engaging said bottom radiused portions and extending through the mounting openings in the other adaptor links to thereby secure said mounting bracket base to said upper ends of said adaptor links.

* * * * *